US008302960B2

(12) United States Patent
Kato et al.

(10) Patent No.: US 8,302,960 B2
(45) Date of Patent: Nov. 6, 2012

(54) BANKNOTE PROCESSING APPARATUS WITH SEPARATING AND FEEDING PORTION

(75) Inventors: Yoshiyuki Kato, Tokyo (JP); Tomohisa Oe, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 0 days.

(21) Appl. No.: 13/083,638

(22) Filed: Apr. 11, 2011

(65) Prior Publication Data

US 2011/0248442 A1 Oct. 13, 2011

(30) Foreign Application Priority Data

Apr. 13, 2010 (JP) ..... P2010-092331

(51) Int. Cl.
*B65H 1/06* (2006.01)

(52) U.S. Cl. ..... 271/165; 271/119

(58) Field of Classification Search ..... 271/165, 271/166, 23, 131, 133, 134, 119, 109, 149
See application file for complete search history.

(56) References Cited

U.S. PATENT DOCUMENTS

| | | | | |
|---|---|---|---|---|
| 3,173,684 | A * | 3/1965 | Binzoni et al. | 271/122 |
| 4,306,713 | A | 12/1981 | Avritt et al. | |
| 4,443,006 | A * | 4/1984 | Hasegawa | 271/10.11 |
| 5,350,168 | A * | 9/1994 | Sheridan | 271/122 |
| 5,393,045 | A * | 2/1995 | Fujimoto | 271/23 |
| 5,938,191 | A * | 8/1999 | Morrison et al. | 271/182 |
| 2007/0222135 | A1 | 9/2007 | Haug | |
| 2009/0008862 | A1 | 1/2009 | Sato et al. | |
| 2010/0308527 | A1 | 12/2010 | Sato et al. | |

FOREIGN PATENT DOCUMENTS

| | | | |
|---|---|---|---|
| EP | 0 038 901 | A2 | 11/1981 |
| EP | 1 821 265 | A1 | 8/2007 |
| EP | 1 832 536 | A1 | 9/2007 |
| JP | 05124774 | A * | 5/1993 |
| JP | 6-69857 | | 9/1994 |

OTHER PUBLICATIONS

Extended European Search Report in EP 11 16 1575 dated Jul. 28, 2011.

* cited by examiner

*Primary Examiner* — Jeremy R Severson
(74) *Attorney, Agent, or Firm* — Nixon & Vanderhye P.C.

(57) ABSTRACT

A banknote processing apparatus according to the present invention includes a banknote separating and feeding portion which separates, from banknotes, one feed-out banknote closest to a banknote holding portion, and feeds out the feed-out banknote. The banknote separating and feeding portion includes a feed roller, a separating roller, a kick-on roller, and auxiliary rollers. The auxiliary rollers are positioned on an opposite side of the kick-on roller from the feed roller, protrude onto the banknote pressing portion side beyond the banknote holding surface, and contact with the feed-out banknote. Each of the auxiliary rollers has a plurality of large diameter portions formed intermittently in a circumferential direction of the auxiliary roller. The auxiliary rollers are positioned on the same axis and apart from each other such that phases of mutually adjacent auxiliary rollers in a rotation direction of the auxiliary rollers are offset from each other.

6 Claims, 4 Drawing Sheets

BANKNOTE PROCESSING APPARATUS WITH SEPARATING AND FEEDING PORTION

BACKGROUND OF THE INVENTION

1. Field of the Invention

The present invention relates to a banknote processing apparatus that individually separates accumulated banknotes and then takes them in.

Priority is claimed on Japanese Patent Application No. 2010-092331, filed Apr. 13, 2010, the contents of which are incorporated herein by reference.

2. Description of Related Art

Conventionally, there exist sheet paper separating and transporting apparatuses that individually separate sheet paper such as a large quantity of banknotes and perform processing to take them into the apparatus body. A sheet paper separating and transporting apparatus which is disclosed in Japanese Patent Publication No. H06-69857 (see, FIGS. 1, 2, and 8) forms a continuous gap between accumulated paper sheets, and greatly reduces the friction resistance between the paper sheets which is generated by the weight of the paper sheets themselves, so that the paper sheets can be consistently separated and transported one by one.

In the aforementioned sheet paper separating and transporting apparatus includes a storage section, a feed section, a supporting section, separating and transporting section, and a drive force transmission section. The storage section accumulates and stores paper sheets. The feed section feeds out the paper sheets accumulated and stored in the storage section in sequence from the sheet located at the bottom. The supporting section supports the paper sheets on an upstream side in the feed direction of the paper sheets accumulated and stored in the storage section. The separating and transporting section is located on the downstream side in the feed direction from the feed section, and sequentially separates and transports individually the sheets of paper fed by the feed section. The drive force transmission section transmits drive force from the separating and transporting section to the supporting section. The supporting section provides rotation in the feed direction of the paper sheets via the drive force transmission section. For each section, the length in the feed direction of the sheet paper itself is defined as LP, a distance between a position slightly on the upstream side in the feed direction from a separating action portion of the separating section and an end portion on the downstream side in the feed direction of the supporting section is defined as LF, and a distance between a side surface on the downstream side in the feed direction of the storage section and the end portion on the downstream side in the feed direction of the supporting section is defined as LH. In this case, in the sheet paper separating and transporting apparatus, the respective sections are arranged such that LP<LF and such that LH<LP.

In an apparatus that is constructed in this manner, a continuous gap is formed between accumulated paper sheets, and the friction resistance between the paper sheets which is generated by the weight of the paper sheets themselves is greatly reduced, so that the paper sheets can be separated and transported one by one with consistency.

Furthermore, according to an example in which a plurality of projections are provided on an outer circumferential side of supporting feed rollers which are serving as supporting feed portions for the paper sheets, by driving a rotation shaft, vibration is imparted to the opposite side from the sheet paper discharge side so that friction resistance between the paper sheets is lessened.

However, the supporting feed rollers which serve as sheet paper supporting feed portions extend in an orthogonal direction relative to the sheet paper feed direction and are arranged in the form of a single roller. Moreover, due to the shape of the supporting feed rollers, when vibration is imparted to the opposite side from the sheet paper discharge side, there is a possibility of noise being generated at the same time.

SUMMARY OF THE INVENTION

The present invention has been conceived in view of the above described circumstances. An object of the present invention is to provide a banknote processing apparatus that makes it possible to form a continuous gap between accumulated banknotes, and to greatly reduce at least the friction resistance between the banknotes which is generated by the weight of the banknotes themselves so that the banknotes can be separated and transported one by one with consistency, and that is also able to reduce the noise generated when the continuous gap is formed between accumulated banknotes.

A banknote processing apparatus according to the present invention includes a banknote pressing portion, a banknote holding portion, a banknote separating and feeding portion. The banknote pressing portion moves in both an opening direction and a closing direction, and presses accumulated banknotes by moving in the closing direction. The banknote separating and feeding portion separates, from the banknotes, one feed-out banknote closest to the banknote holding portion, and feeds out the feed-out banknote. The banknote separating and feeding portion includes a feed roller, a separating roller, a kick-on roller, and a plurality of auxiliary rollers. The feed roller contacts with the feed-out banknote. The separating roller is positioned facing the feed roller with the feed-out banknote therebetween. The kick-on roller which protrudes onto the banknote pressing portion side beyond the banknote holding surface, and contacts with the feed-out banknote. The auxiliary rollers are positioned on an opposite side of the kick-on roller from the feed roller, protrude onto the banknote pressing portion side beyond the banknote holding surface, and contact with the feed-out banknote. Each of the auxiliary rollers has a plurality of large diameter portions formed intermittently in a circumferential direction of the auxiliary roller. The auxiliary rollers are positioned on the same axis and apart from each other such that phases of mutually adjacent auxiliary rollers in a rotation direction of the auxiliary rollers are offset from each other.

According to the present invention, the auxiliary rollers are positioned on an opposite side of the kick-on roller from the feed roller and positioned on the same axis. Furthermore, each of the auxiliary rollers has a plurality of large diameter portions formed intermittently in a circumferential direction of the auxiliary roller. Accordingly, it is possible to form a continuous gap between accumulated banknotes, and to greatly reduce at least the friction resistance between banknotes which is generated by the weight of the banknotes themselves, and to separate banknotes one-by-one and then retrieve them with consistency.

Moreover, according to the present invention, the auxiliary rollers are apart from each other such that phases of mutually adjacent auxiliary rollers in a rotation direction of the auxiliary rollers are offset from each other. Therefore, mutually adjacent auxiliary rollers make contact with the banknote at offset timings so that the banknote handling effectiveness is increased, and the noise generated from this contact with the banknote can be reduced. Accordingly, it is possible to properly form a continuous gap between accumulated banknotes, and to also achieve a reduction in the noise at this time.

In the above-described banknote processing apparatus, the kick-on roller and the auxiliary rollers may form a part of the banknote holding portion.

In the above-described banknote processing apparatus, the auxiliary rollers may have a substantially equilateral triangle shape, and the phases of the mutually adjacent auxiliary rollers in the rotation direction may be offset from each other by 60°. By employing this structure, the timings of the contacts made by mutually adjacent auxiliary rollers can be separated by equal intervals from each other so that the noise generated from this contact with the banknote can be reliably reduced. Accordingly, it is possible to reliably achieve a reduction in the noise generated when a continuous gap is formed between accumulated banknotes.

In the above-described banknote processing apparatus, the auxiliary rollers may have a substantially square shape, and the phases of the mutually adjacent auxiliary rollers in the rotation direction may be offset from each other by 45°. By employing this structure, the timings of the contacts made by mutually adjacent auxiliary rollers can be separated by equal intervals from each other so that the noise generated from this contact with the banknote can be reliably reduced. Accordingly, it is possible to reliably achieve a reduction in the noise generated when a continuous gap is formed between accumulated banknotes.

In the above-described banknote processing apparatus, the auxiliary rollers may have a substantially pentagon shape, and the phases of the mutually adjacent auxiliary rollers in the rotation direction may be offset from each other by 36°. By employing this structure, the timings of the contacts made by mutually adjacent auxiliary rollers can be separated by equal intervals from each other so that the noise generated from this contact with the banknote can be reliably reduced. Accordingly, it is possible to reliably achieve a reduction in the noise generated when a continuous gap is formed between accumulated banknotes.

In the above-described banknote processing apparatus, a separation action point between the feed roller and the separating roller, a kick-on action point where the kick-on roller makes contact with the feed-out banknote, and at least one of the large diameter portions of the auxiliary rollers may be positioned on the same straight line. By employing this structure, a banknote can be properly kicked onwards by the kick-on roller and the auxiliary rollers towards the separation action point between the feed roller and the separating roller.

DETAILED DESCRIPTION OF THE INVENTION

Figure 1:
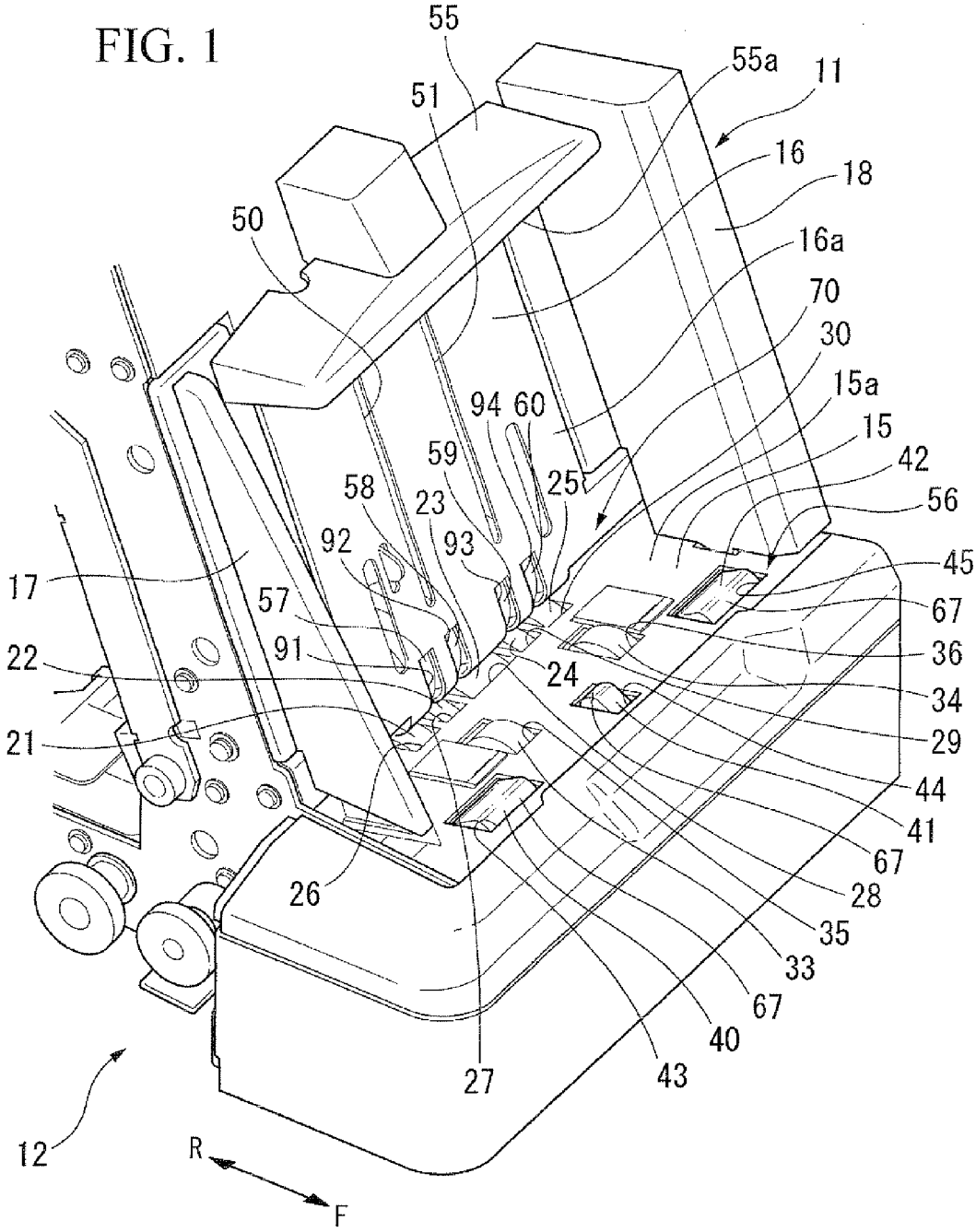
FIG. 1 is a perspective view showing a portion of a banknote processing apparatus according to an embodiment of the present invention.

A banknote processing apparatus according to an embodiment of the present invention will now be described with reference made to the drawings. Note that in the following description, the side closest to an operator is referred to as being the 'front (indicated as "F" in the drawing)', while the side opposite the operator is referred to as being the 'rear (indicated as "R" in the drawing)', and 'left' and 'right' refer to left and right as seen by such an operator.

FIG. 1 shows the vicinity of a banknote receptacle unit 11 which is a portion of a banknote processing apparatus. The banknote receptacle unit 11 is located at a front face of an apparatus main body 12 (only a portion of the main body 12 is shown in the drawing) and accepts banknotes that are placed thereon. The banknotes are placed on the banknote receptacle unit 11 and are stacked vertically with their longitudinal direction being aligned with the left-right direction (that is, lateral direction) of the banknote processing apparatus.

The banknote receptacle unit 11 includes a banknote holding plate portion 15 which forms a bottom portion thereof, a banknote guide plate portion 16 which forms a rear portion thereof, and a side wall portion 17 and a side wall portion 18 that form the left and right portions thereof.

The banknote holding plate portion 15 has a holding surface 15*a* which forms a top surface thereof. The banknote holding plate portion 15 is placed such that the banknote holding surface 15*a* is inclined from the horizontal slightly downwards towards the rear thereof. Feed roller aperture portions 26, 27, 28, 29, and 30 are provided in a plurality of, specifically, in five locations extending in the left-right direction at a rear portion on the banknote guide plate portion 16 side of the banknote holding plate portion 15. A plurality of, specifically, five feed rollers 21, 22, 23, 24, and 25 are provided in parallel below the feed roller aperture portions 26 to 30. The positions of the feed rollers 21 to 25 are matched in both of the front-rear direction and the up-down direction. Portions of the feed rollers 21 to 25 protrude above the feed roller aperture portions 26 to 30.

Kick-on roller aperture portions 35 and 36 are provided in parallel in the left-right direction in a plurality of, specifically, in two locations on the front side of the feed roller aperture portions 26 to 30 of the banknote holding plate portion 15. A plurality of, specifically, two kick-on rollers 33 and 34 are provided in parallel below the kick-on roller aperture portions 35 and 36. The positions of the kick-on rollers 33 and 34 are matched in both of the front-rear direction and the up-down direction. Portions of the kick-on rollers 33 and 34 protrude above the kick-on roller aperture portions 35 and 36.

Auxiliary roller aperture portions 43, 44, and 45 are provided in parallel in the left-right direction in a plurality of, specifically, in three locations on the front side of the kick-on roller aperture portions 35 and 36 of the banknote holding plate portion 15. A plurality of, specifically, three auxiliary rollers 40, 41, and 42 are provided in parallel below the auxiliary roller aperture portions 43 to 45. The positions of the auxiliary rollers 40 to 42 are matched in both of the front-rear direction and the up-down direction. Portions of the auxiliary rollers 40 to 42 protrude above the auxiliary roller aperture portions 43 to 45.

The left side kick-on roller aperture portion 35 is arranged between the feed roller aperture portion 26 on the left end and the feed roller aperture portion 27 which is positioned to the immediate right of the aperture portion 26. The right side kick-on roller aperture portion 36 is arranged between the feed roller aperture portion 30 on the right end and the feed roller aperture portion 29 which is positioned to the immediate left of the aperture portion 29. The left end auxiliary roller aperture portion 43 is provided on the left side of the left side kick-on roller aperture portion 35. The right end auxiliary roller aperture portion 45 is arranged on the right side of the right side kick-on roller aperture portion 36. The center auxiliary roller aperture portion 44 is provided between the left side kick-on roller aperture portion 35 and the right side kick-on roller aperture portion 36.

In other words, the left side kick-on roller 33 is located between the left end feed roller 21 and the feed roller 22 positioned immediately to the right of the feed roller 21. The right side kick-on roller 34 is located between the right end feed roller 25 and the feed roller 24 positioned immediately to the left of the feed roller 24. The left end auxiliary roller 40 is located on the left side of the left side kick-on roller 33. The right end auxiliary roller 42 is located on the right side of the right side kick-on roller 34. The center auxiliary roller 41 is located between the left side kick-on roller 33 and the right side kick-on roller 34. Accordingly, the kick-on roller 33 is located between the mutually adjacent auxiliary rollers 40 and 41, and the kick-on roller 34 is located between the mutually adjacent auxiliary rollers 41 and 42.

The five feed rollers 21 to 25, the two kick-on rollers 33 and 34, and the three auxiliary rollers 40 to 42 are provided in the front and rear directions directly below the banknote holding plate portion 15 of the banknote receptacle unit 11. The feed rollers 21 to 25 are provided behind the banknote guide plate portion 16. The kick-on rollers 33 and 34 are provided in front of the banknote guide plate portion 16. The auxiliary rollers 40 to 42 are provided in front of the kick-on rollers 33 and 34. In other words, looking from the front of the apparatus, the three auxiliary rollers 40 to 42, the two kick-on rollers 33 and 34, and the five feed rollers 21 to 25 are provided in this sequence directly below the banknote holding plate portion 15 of the banknote receptacle unit 11.

Spacing $S_1$ between the five feed rollers 21 to 25 and the three auxiliary rollers 40 to 42 is set to be slightly less than the width of the banknotes having the shortest width in the transverse direction out of the banknotes handled by the apparatus. Spacing $S_2$ between the five feed rollers 21 to 25 and the two kick-on rollers 33 and 34 is set to be approximately half the width of the banknotes having the shortest width in the transverse direction out of the banknotes handled by the apparatus. Spacing $S_3$ between the banknote guide surface 16*a* which is the front face of the banknote guide plate portion 16 and the two kick-on rollers 33 and 34 is set to be approximately one third the width of the banknotes having the shortest width in the transverse direction out of the banknotes handled by the apparatus. Therefore, the relations between the spacing $S_1$, $S_2$ and $S_3$ can be expressed as $S_1 \cong 2S_2 \cong 3S_3$.

A separation action point between the five feed rollers 21 to 25 and four separating rollers 57, 58, 59, and 60 (described below) is defined as a separation action point A. A kick-on action point where the two kick-on rollers 33 and 34 come into contact with the banknotes is defined as a kick-on action point B. A kick-on action point where the three auxiliary rollers 40 to 42 come into contact with the banknotes is defined as a kick-on action point C. In this case, more accurately, Spacing $T_1$ between the separation action point A and the action point C is set to be slightly less than the width of the banknotes having the shortest width in the transverse direction out of the banknotes handled by the apparatus. Spacing $T_2$ between the separation action point A and the action point B is set to be approximately half the width of the banknotes having the shortest width in the transverse direction out of the banknotes handled by the apparatus. Spacing $T_3$ between the banknote guide surface 16*a* which is the front face of the banknote guide plate portion 16 and the kick-on action point B is set to be approximately one third the width of the banknotes having the shortest width in the transverse direction out of the banknotes handled by the apparatus. Therefore, the relations between the spacing $T_1$, $T_2$ and $T_3$ can be expressed as $T_1 < 2T_2 \cong 3T_3$.

The banknote guide surface 16*a* which is the front face of the banknote guide plate portion 16 is positioned above the feed roller aperture portions 26 to 30 of the banknote holding plate portion 15. The banknote guide surface 16*a* is inclined such that an upper side of the surface 16*a* is positioned slightly towards the rear relative to the vertical. A plurality of, specifically, two slits 50 and 51 which extend in an up-down direction are fowled in the banknote guide plate portion 16. The slits 50 and 51 are separated from each other in the left-right direction. A banknote pressing portion 55 is provided on the front side of the banknote guide plate portion 16. The banknote pressing portion 55 moves along the slits 50 and 51 while causing a sliding portion (not shown) to slide inside these slits 50 and 51.

A banknote pressing surface 55*a* which is a bottom surface of the banknote pressing portion 55 is placed parallel with the banknote holding surface 15*a*. In this state, the banknote pressing portion 55 is supported on the sliding portion (not shown) such that it is able to move in both a closing direction in which it approaches the banknote holding surface 15*a* of the banknote holding plate portion 15, and an opening direction in which it moves away from the banknote holding surface 15*a*. The banknote pressing portion 55 is moved in the closing direction by its own weight.

Banknotes which are stacked up in a vertical direction with their longitudinal direction aligned with the left-right direction are in contact with the banknote guide surface 16*a* of the banknote guide plate portion 16. In this state, the stacked-up banknotes stacked between the banknote holding surface 15*a* of the banknote holding plate portion 15 and the banknote pressing surface 55*a* of the banknote pressing portion 55. When the banknote pressing portion 55 is moved by its own weight in the closing direction, banknotes which have been placed on top of the banknote holding plate portion 15, the kick-on rollers 33 and 34, and the auxiliary rollers 40 to 42 become held between these and the banknote pressing portion 55.

With the above constitution, the banknote holding plate portion 15, the kick-on rollers 33 and 34, and the auxiliary rollers 40 to 42 constitute a banknote holding portion 56 which holds the banknotes which are placed in the receptacle unit 11 and are pressed as a result of the movement in the closing direction by the banknote pressing portion 55. When the banknotes have been loaded in the receptacle unit 11 in this manner, the kick-on rollers 21 to 25 are able to make contact with the banknote located closest to the banknote holding portion 56 side. The kick-on rollers 33 and 34 form a part of the banknote holding portion 56, and because they protrude beyond the banknote holding surface 15*a* onto the banknote pressing portion 55 side, they are able to make contact with the banknote which has been loaded onto the banknote holding portion 56 and is located closest to the banknote holding portion 56 side.

The auxiliary rollers 40 to 42 form a part of the banknote holding portion 56, and are located on the opposite side to the feed rollers 21 to 25 with respect to the kick-on rollers 33 and 34, and protrude beyond the banknote holding surface 15*a* onto the banknote pressing portion 55 side. By employing this type of structure, the auxiliary rollers 40 to 42 are able to make contact with the opposite side from the feed rollers 21 to 25 of the banknote which has been loaded onto the banknote holding portion 56 and is located closest to the banknote holding portion 56 side. The kick-on rollers 33 and 34 make contact with the banknotes on the feed roller 21 to 25 side of the auxiliary rollers 40 to 42.

A plurality of, specifically, four separating rollers 57 to 60 are provided in a line in the left-right direction behind the banknote guide plate portion 16. A bent guide portion is formed which is continuous with the bottom end portion of the banknote guide surface 16*a*, and is bent backwards therefrom at substantially 90°. Portions of these separating rollers 57 to 60 protrude downwards beyond separating roller aperture portions 91, 92, 93, and 94 of this bent guide portion. The separating roller 57 is positioned between the feed roller 21 on the left end and the feed roller 22 which is positioned to the immediate right of the roller 21. The separating roller 58 is positioned between the feed roller 22 located second from the left end and the feed roller 23 which is positioned to the immediate right of the roller 23, namely, is positioned in the center. The separating roller 59 is positioned between the center feed roller 23 and the feed roller 24 which is positioned to the immediate right of the roller 23, namely, is positioned second from the right end. The separating roller 60 is positioned between the feed roller 24 located second from the right end and the feed roller 25 which is positioned to the immediate right of the roller 24, namely, is positioned on the right end. The separating rollers 57 to 60 and the feed rollers 21 to 25 are arranged in what is known as a comb teeth shape when viewed from the front-rear direction, and grip the banknotes in a corrugated manner in the left-right direction, namely, in an undulating manner so that the banknotes are fed one-by-one.

The plurality of feed rollers 21 to 25 have the same diameter, and their outer circumferential surfaces have a cylindrical surface shape over the entire circumference thereof. The plurality of feed rollers 21 to 25 are fixed at a central position of each one to a rotation shaft 62 (see FIG. 2) that extends in the left-right direction. The plurality of separating rollers 57 to 60 shown in FIG. 1 have the same diameter, and their outer circumferential surfaces have a cylindrical surface shape over the entire circumference thereof. The plurality of separating rollers 57 to 60 are fixed at a central position of each one to a rotation shaft 63 (see FIG. 2) that extends in the left-right direction. The plurality of kick-on rollers 33 and 34 shown in FIG. 1 have the same diameter, and their outer circumferential surfaces have a cylindrical surface shape over the entire circumference thereof. The plurality of kick-on rollers 33 and 34 are fixed at a central position of each roller to a rotation shaft 64 (see FIG. 2) that extends in the left-right direction.

The auxiliary rollers 40 to 42 have three large diameter portions 67 of a cylindrical surface shape, and three flattened portions 68. The three large diameter portions 67 are located at the positions of the apex points of an equilateral triangle. The three flattened portions 68 connect together mutually adjacent large diameter portions 67. The three large diameter portions 67 form a cylindrical surface which has the same fixed diameter from the center of the auxiliary rollers 40 to 42. In addition, the lengths in the circumferential direction of the three large diameter portions 67 are the same. As a result of this, the angle between mutually adjacent flattened portions 68 is 60°. Namely, the auxiliary rollers 40 to 42 have the same diameter, and are shaped as substantially equilateral triangles in which the large diameter portions 67 which make up the maximum diameter portions are formed intermittently in a plurality of, specifically, in three mutually equidistant locations in the circumferential direction. In addition, the auxiliary rollers 40 to 42 are fixed at a central position of each roller to a rotation shaft 69 which extends in the left-right direction. Accordingly, the plurality of auxiliary rollers 40 to 42 are positioned on the same axis.

Figure 3A:
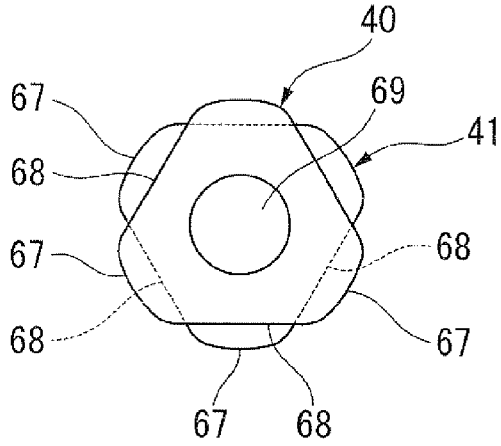
FIG. 3A is a side view seen from one side in the axial direction showing an auxiliary rollers and rotation shaft of the banknote processing apparatus according to the embodiment of the present invention.
Figure 3B:
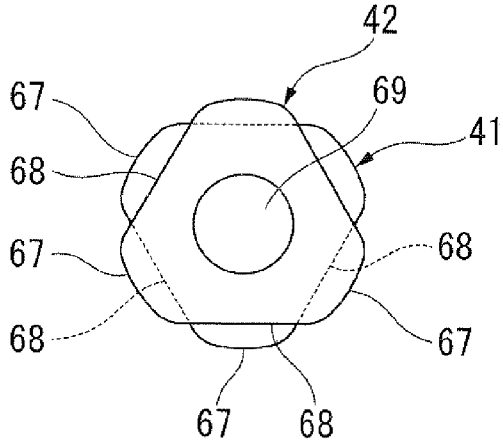
FIG. 3B is a side view seen from the opposite side in the axial direction showing the auxiliary rollers and rotation shaft of the banknote processing apparatus according to the embodiment of the present invention.

In the present embodiment, as is shown in FIGS. 3A and 3B, the plurality of substantially equilateral triangle-shaped auxiliary rollers 40 to 42 are separated from each other in the axial direction such that the phases in the rotation direction of mutually adjacent rollers are offset. Specifically, the phases in the rotation direction of the mutually adjacent auxiliary rollers 40 and 41 are offset from each other by 60°, and the phases in the rotation direction of the mutually adjacent auxiliary rollers 41 and 42 are offset from each other by 60°. Accordingly, the phases in the rotation direction of the auxiliary rollers 40 and 42 located at the two ends are the same as each other. In other words, the mutually adjacent rollers 40 and 41 (or 41 and 42) are displaced by 60° from each other around the rotation direction of the mutually adjacent rollers 40 and 41 (or 41 and 42).

Figure 2:
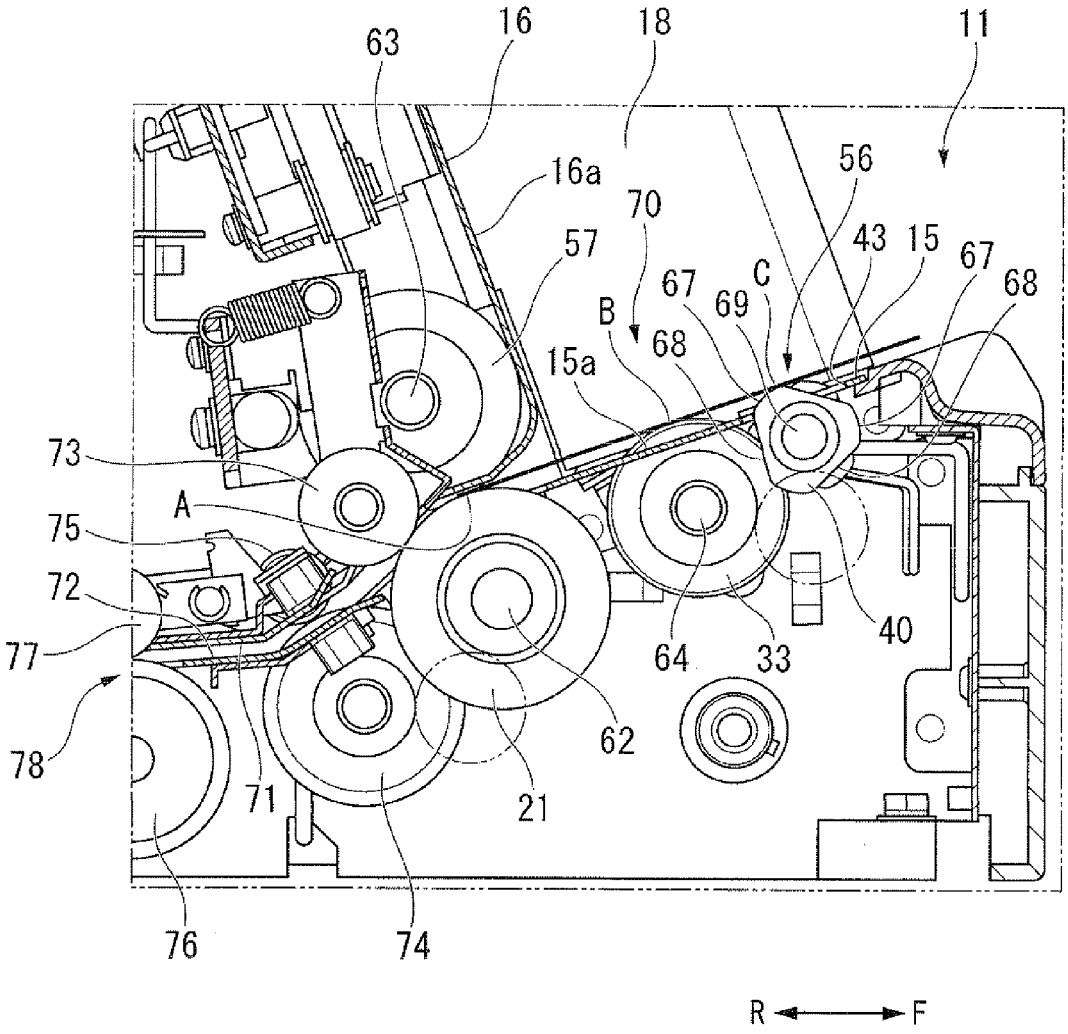
FIG. 2 is a side cross-sectional view showing a portion of the banknote processing apparatus according to the embodiment of the present invention.

As is shown in FIG. 2, the height relationships and the positional relationships in the front-rear direction of the rotation shafts 62, 64, and 69 are set such that the separation action point A, the kick-on action point B, and the kick-on action point C can be positioned on the same straight line even for the banknotes which have the shortest width in the transverse direction from among the banknotes handled by the apparatus. The large diameter portions 67 of the auxiliary rollers 40 to 42 are set such that they are never located above an extended line of a line connecting the separation action point A and the kick-on action point B on the opposite side from the banknote holding surface 15*a*.

The rotation shaft 62 supports the feed rollers 21 to 25. The rotation shaft 64 supports the kick-on rollers 33 and 34. The rotation shaft 69 supports the auxiliary rollers 40 to 42. The rotation shaft 62, the rotation shaft 64, and the rotation shaft 69 are driven by a single motor, and are rotated in synchronization with each other in the same circumferential direction (i.e., in an anticlockwise direction in FIG. 2). As a result, the feed rollers 21 to 25, the kick-on rollers 33 and 34, and the auxiliary rollers 40 to 42 are also rotated in synchronization with each other in the same circumferential direction (i.e., in an anticlockwise direction in FIG. 2). In contrast, the rotation shaft 63 which supports the separating rollers 57 to 60 is only permitted by a one-way clutch to rotate in the same direction as the rotation shafts 62, 64, and 69 (i.e., in an anticlockwise direction in FIG. 2).

In the above described receptacle unit 11, banknotes which are stacked up in a vertical direction with their longitudinal direction aligned with the left-right direction are in contact with the banknote guide surface 16*a* of the banknote guide plate portion 16. In this state, the stacked-up banknotes are stacked between the banknote holding surface 15*a* of the banknote holding plate portion 15 and the banknote pressing surface 55*a* of the banknote pressing portion 55.

In this state, when the feed rollers 21 to 25, the kick-on rollers 33 and 34, and the auxiliary rollers 40 to 42 are rotated in synchronization with each other as a result of the rotation shafts 62, 64, and 69 rotating in synchronization, the kick-on rollers 33 and 34 and the auxiliary rollers 40 to 42 are in contact with the banknote closest to the banknote holding portion 56 side and kick this banknote towards the feed rollers 21 to 25 side. As a result, the feed rollers 21 to 25 come into contact with the banknote closest to the banknote holding portion 56 side and, while gripping this banknote between themselves and the separating rollers 57 to 60, feed it inside the apparatus main body 12.

At this time, the separating rollers 57 to 60 which are in a stopped state separate the banknotes other than the banknote which is closest to the banknote holding portion 56 side and which is in contact with the feed rollers 21 to 25. Moreover, at this time, in the auxiliary rollers 40 to 42, the large diameter portions 67 of the auxiliary rollers 40 and 42 which are located on the two ends in the axial direction kick the banknote while in contact therewith, and the large diameter portions 67 of the auxiliary roller 41 which is located in the center in the axial direction kick the banknote while in contact therewith. The kicking of the banknote by the large diameter portions 67 of the auxiliary rollers 40 and 42 alternates with the kicking of the banknote by the large diameter portions 67 of the auxiliary roller 41. Moreover, after large diameter portions 67 of the auxiliary rollers 40 and 42 have released their contact with a banknote, after an interval, a large diameter portion 67 of the auxiliary roller 41 comes into contact with the banknote. Namely, rollers which are adjacent to each other in the axial direction from among the auxiliary rollers 40 to 42 come into contact intermittently with the banknote which is closest to the banknote holding portion 56 side.

The above described feed rollers 21 to 25, separating rollers 57 to 60, kick-on rollers 33 and 34, and auxiliary rollers 40 to 42 make up a banknote separating and feeding portion 70 which separates banknotes one-by-one from the banknotes on the banknote holding portion 56 side and feeds these banknotes on.

Guide plates 71 and 72, a transporting roller 73, transporting rollers 74 and 75, and transporting rollers 76 and 77 and the like are provided to the rear of the separating action point A between the feed rollers 21 to 25 and the separating rollers 57 to 60. The guide plates 71 and 72 guide banknotes which are fed from between the feed rollers 21 to 25 and separating rollers 57 to 60 from both sides in the thickness direction of the banknote. The transporting roller 73 transports the banknotes between the guide plates 71 and 72 while gripping them between the roller 73 and the feed rollers 21 to 25. The transporting rollers 74 and 75 transport banknotes between the guide plates 71 and 72 while gripping them between the rollers 74 and 75. The transporting rollers 76 and 77 transport banknotes between the guide plates 71 and 72 while gripping them between the rollers 76 and 77. The guide plates 71 and 72, the transporting roller 73, the transporting rollers 74 and 75, and the transporting rollers 76 and 77 and the like make up an internal processing mechanism 78. The internal processing mechanism 78, while transporting banknotes which have been fed by the banknote separating and feeding portion 70, performs processing thereon such as, for example, sorting, counting, and storing the various banknote denominations.

According to the above described present embodiment, the plurality of auxiliary rollers 40 to 42 in which the plurality of large diameter portions 67 are formed intermittently in the circumferential direction are positioned on the same axis on the opposite side of the kick-on rollers 33 and 34 from the feed rollers 21 to 25. By employing this structure, it is possible to handle banknotes effectively. Accordingly, it is possible to form a continuous gap between collected banknotes, and to greatly reduce at least the friction resistance between banknotes which is generated by the weight of the banknotes themselves, and to separate banknotes one-by-one and then retrieve them with consistency.

Moreover, when feeding banknotes whose widths in the banknote feed direction are comparatively different, even those banknotes which have the shortest width in the transverse direction from among the banknotes handled by the apparatus are at least supported by the feed rollers 33 and 34 and the auxiliary rollers 40 to 42 which are located at different positions in the front-rear direction, and are kicked alternatingly at short time intervals by any of the auxiliary rollers 40 to 42. By employing this structure, banknotes can be kicked towards the separation action point A between the feed rollers 21 to 25 and the separating rollers 57 to 60 in the desired manner.

That is, if the auxiliary rollers 40 to 42 were not provided, then when banknotes having comparatively different widths in the banknote feed direction were being fed, the upstream side in the feed direction of the banknotes having the longer widths would be lifted up with the point where the feed rollers 33 and 34 were in contact with the banknotes forming the support point, and when the banknotes were kicked on, the distal end portion thereof in the banknote feed direction would be kicked slightly upwards so that there is a possibility that they would not be able to be fed properly towards the separation action point A. In contrast, according to the present embodiment, it is possible to prevent this type of situation from occurring.

Moreover, because the plurality of auxiliary rollers 40 to 42 are positioned apart from each other with the phases in the rotation direction of mutually adjacent rollers offset from each other, mutually adjacent rollers make contact with the banknotes at offset timings. By employing this structure, the banknote handling effectiveness is increased (i.e., the number of times a banknote makes contact with the large diameter portions 67 per one revolution of the rotation shaft 69 is doubled), and the noise generated from this contact with the banknotes can be reduced. Accordingly, it is possible to properly form a continuous gap between collected banknotes, and to also achieve a reduction in the noise at this time.

Moreover, the auxiliary rollers 40 to 42 have a substantially equilateral triangle shape, and the phases in the rotation direction of mutually adjacent rollers are mutually offset by 60°. By employing this structure, the timings of the contact with a banknote by mutually adjacent rollers can be equidistantly separated from each other, and the noise generated from this contact with the banknotes can be reliably reduced. Accordingly, it is possible to achieve a reliable reduction in the noise generated when a continuous gap is formed between collected banknotes.

Furthermore, the separation action point A between the feed rollers 21 to 25 and the separating rollers 57 to 60, the kick-on action point B where the kick-on rollers 33 and 34 make contact with a banknote, and the large diameter portions 67 of the auxiliary rollers 40 to 42 can be positioned on the same straight line. By employing this structure, a banknote can be properly kicked onwards by the kick-on rollers 33 and 34 and the auxiliary rollers 40 to 42 on a substantially straight line towards the separation action point A between the feed rollers 21 to 25 and the separating rollers 57 to 60. Accordingly, banknotes can be retrieved with more stability to the inside of the apparatus main body 12.

Note that it is sufficient for a plurality of the large diameter portions 67 which make up the maximum diameter portions to be formed intermittently in the circumferential direction on the auxiliary rollers 40 to 42, and the present embodiment is not limited to the above described structure.

Figure 4A:
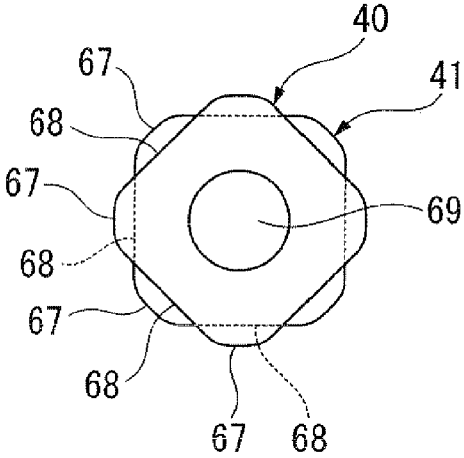
FIG. 4A is a side view seen from one side in the axial direction showing a variant example of the auxiliary rollers of the banknote processing apparatus according to the embodiment of the present invention.
Figure 4B:
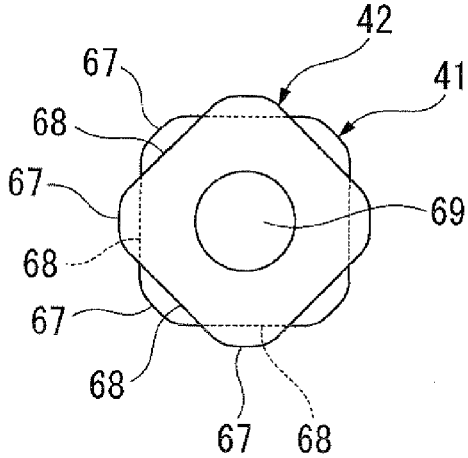
FIG. 4B is a side view seen from the opposite side in the axial direction showing the variant example of the auxiliary rollers of the banknote processing apparatus according to the embodiment of the present invention.

For example, as shown in FIGS. 4A and 4B, the auxiliary rollers 40 to 42 may be substantially a square shape with the large diameter portions 67 being formed in four equidistant locations. That is, the auxiliary rollers 40 to 42 have four large diameter portions 67 and four flattened portions 68. The four large diameter portions 67 all have the same diameter and are located at the apex points of a square, and are shaped as a cylindrical surface having a fixed diameter. The four flattened portions 68 connect together mutually adjacent large diameter portions 67. In this case as well, the lengths in the circumferential direction of the four large diameter portions 67 are the same so that, as a result of this, the angle between mutually adjacent flattened portions 68 is 90°.

Of the plurality of substantially square-shaped auxiliary rollers 40 to 42, the phases in the rotation direction of the mutually adjacent auxiliary rollers 40 and 41 are offset from each other by 45°. The phases in the rotation direction of the mutually adjacent auxiliary rollers 41 and 42 are offset from each other by 45°. Accordingly, the phases in the rotation direction of the auxiliary rollers 40 and 42 located at the two ends are the same as each other. In this case as well, in the same way as is described above, the height relationships and the positional relationships in the front-rear direction of the rotation shafts 62, 64, and 69 are set such that the separation action point A between the feed rollers 21 to 25 and the separating rollers 57 to 60, the kick-on action point B where the kick-on rollers 33 and 34 make contact with the banknotes, and the large diameter portions of the auxiliary rollers 40 to 43 can be positioned on the same straight line.

In this manner, if the auxiliary rollers 40 to 42 have a substantially square shape, and the phases in the rotation direction of mutually adjacent rollers are offset from each other by 45°, then in the same way as is described above, the timings of the contact with a banknote by mutually adjacent rollers can be equidistantly separated from each other, and the noise generated from this contact with the banknotes can be reliably reduced. Accordingly, it is possible to achieve a reliable reduction in the noise generated when a continuous gap is formed between collected banknotes.

Figure 5A:
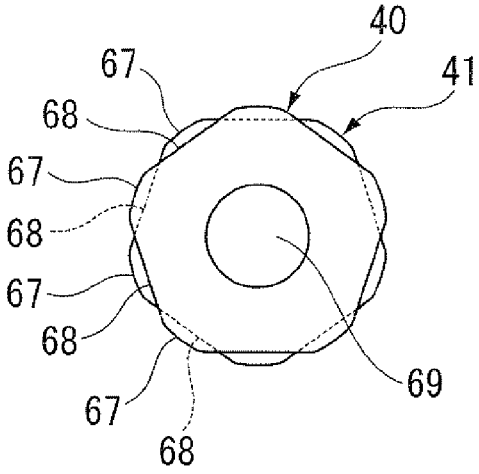
FIG. 5A is a side view seen from one side in the axial direction showing another variant example of the auxiliary rollers of the banknote processing apparatus according to the embodiment of the present invention.
Figure 5B:
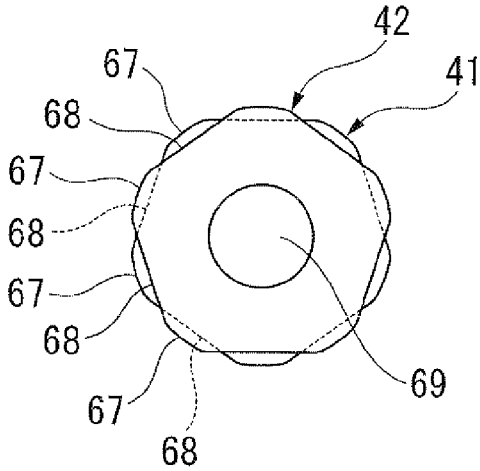
FIG. 5B is a side view seen from the opposite side in the axial direction showing the other variant example of the auxiliary roller of the banknote processing apparatus according to the embodiment of the present invention.

Alternatively, for example, as is shown in FIGS. 5A and 5B, the auxiliary rollers 40 to 42 may have substantially a pentagonal shape with the large diameter portions 67 being formed in five equidistant locations. Namely, the auxiliary rollers 40 to 42 have five large diameter portions 67 and five flattened portions 68. The five large diameter portions 67 all have the same diameter and are located at the apex points of a pentagon, and are shaped as a cylindrical surface having a fixed diameter. The five flattened portions 68 connect together mutually adjacent large diameter portions 67. In this case as well, the lengths in the circumferential direction of the five large diameter portions 67 are the same so that, as a result of this, the angle between mutually adjacent flattened portions 68 is 108°.

Of the plurality of substantially pentagon-shaped auxiliary rollers 40 to 42, the phases in the rotation direction of the mutually adjacent auxiliary rollers 40 and 41 are offset from each other by 36°. The phases in the rotation direction of the mutually adjacent auxiliary rollers 41 and 42 are offset from each other by 36°. Accordingly, the phases in the rotation direction of the auxiliary rollers 40 and 42 located at the two ends are the same as each other. In this case as well, in the same way as is described above, the height relationships and the positional relationships in the front-rear direction of the rotation shafts 62, 64, and 69 are set such that the separation action point A between the feed rollers 21 to 25 and the separating rollers 57 to 60, the kick-on action point B where the kick-on rollers 33 and 34 make contact with the banknotes, and the large diameter portions 67 of the auxiliary rollers 40 to 43 can be positioned on the same straight line.

In this manner, if the auxiliary rollers 40 to 42 have a substantially pentagonal shape, and the phases in the rotation direction of mutually adjacent rollers are offset from each other by 36°, then in the same way as is described above, the timings of the contact with a banknote by mutually adjacent rollers can be equidistantly separated from each other, and the noise generated from this contact with the banknotes can be reliably reduced. Accordingly, it is possible to achieve a reliable reduction in the noise generated when a continuous gap is formed between collected banknotes, As a result of experiments, it was found that when the auxiliary rollers 40 to 42 were formed in a hexagonal shape, the banknote handling effect and the noise reduction effect could not be obtained. Because of this, it is preferable for the auxiliary rollers 40 to 42 to have either an equilateral triangle shape, a square shape, or a pentagon shape.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A banknote processing apparatus comprising:

a banknote pressing portion which moves in both an opening direction and a closing direction, and presses accumulated banknotes by moving in the closing direction;

a banknote holding portion which has a banknote holding surface holding the banknotes pressed by the banknote pressing portion; and a banknote separating and feeding portion which separates, from the banknotes, one feed-out banknote closest to the banknote holding portion, and feeds out the feed-out banknote, the banknote separating and feeding portion including a feed roller which contacts with the feed-out banknote, a separating roller which is positioned facing the feed roller with the feed-out banknote therebetween, a kick-on roller which protrudes onto the banknote pressing portion side beyond the banknote holding surface, and contacts with the feed-out banknote, and a plurality of auxiliary rollers which are positioned on an opposite side of the kick-on roller from the feed roller, protrude onto the banknote pressing portion side beyond the banknote holding surface, and contact with the feed-out banknote, each of the auxiliary rollers having a plurality of large diameter portions formed intermittently in a circumferential direction of the auxiliary roller, the auxiliary rollers positioned on the same axis and apart from each other such that phases of mutually adjacent auxiliary rollers in a rotation direction of the auxiliary rollers are offset from each other.

2. The banknote processing apparatus according claim 1, wherein the kick-on roller and the auxiliary rollers form a part of the banknote holding portion.

3. The banknote processing apparatus according to claim 1, wherein the auxiliary rollers have a substantially equilateral triangle shape, and the phases of the mutually adjacent auxiliary rollers in the rotation direction are offset from each other by 60°.

4. The banknote processing apparatus according to claim 1, wherein the auxiliary rollers have a substantially square shape, and the phases of the mutually adjacent auxiliary rollers in the rotation direction are offset from each other by 45°.

5. The banknote processing apparatus according to claim 1, wherein the auxiliary rollers have a substantially pentagon shape, and the phases of the mutually adjacent auxiliary rollers in the rotation direction are offset from each other by 36°.

6. The banknote processing apparatus according to claim 1, wherein a separation action point between the feed roller and the separating roller, a kick-on action point where the kick-on roller makes contact with the feed-out banknote, and at least one of the large diameter portions of the auxiliary rollers are positioned on the same straight line.

* * * * *